United States Patent [19]

Kray

[11] 4,397,737

[45] Aug. 9, 1983

[54] HEAT EXCHANGER ANTIFOULANT

[75] Inventor: Louis R. Kray, Novato, Calif.

[73] Assignee: Chevron Research Company, San Francisco, Calif.

[21] Appl. No.: 352,817

[22] Filed: Feb. 26, 1982

[51] Int. Cl.[3] ..... C10G 9/16

[52] U.S. Cl. ..... 208/48 AA; 44/63; 252/34; 252/51.5 A; 252/52 A; 585/3

[58] Field of Search ..... 208/48 AA, 348; 44/63; 252/34, 51.5 A, 52 A; 585/3

[56] References Cited

U.S. PATENT DOCUMENTS

| | | | |
|---|---|---|---|
| 3,173,770 | 3/1965 | Thompson et al. | 44/63 |
| 4,160,648 | 7/1979 | Lewis et al. | 44/63 |
| 4,191,537 | 3/1980 | Lewis et al. | 44/71 |
| 4,197,409 | 4/1980 | Lilburn | 44/71 X |
| 4,200,518 | 4/1980 | Mulvany | 208/48 AA |
| 4,233,168 | 11/1980 | Lewis et al. | 252/51.5 A |
| 4,236,020 | 11/1980 | Lewis et al. | 44/71 X |
| 4,247,301 | 1/1981 | Honnen | 44/63 |
| 4,288,612 | 9/1981 | Lewis et al. | 44/63 X |

*Primary Examiner*—Delbert E. Gantz
*Assistant Examiner*—G. E. Schmitkons
*Attorney, Agent, or Firm*—D. A. Newell; J. M. Whitney; J. J. DeYoung

[57] ABSTRACT

Disclosed is a process for reducing the fouling in a heat exchanger in which a hydrocarbon stream is heated or cooled as it passes through the heat exchanger. From 1 to 500 parts per million of poly(oxyalkylene) carbamate is added to the stream to reduce fouling.

16 Claims, No Drawings

HEAT EXCHANGER ANTIFOULANT

BACKGROUND OF THE INVENTION

The invention relates to heat exchangers, particularly heat exchangers used in the processing of crude oil. More particularly, the invention relates to an additive for reducing heat exchanger fouling.

In the processing of petroleum, numerous heat exchangers are utilized to heat or cool process streams. Since refineries typically process very large quantities of petroleum ranging from 25,000 to 200,000 or more barrels per day, the heat exchangers in the refinery represent a very large capital investment. After a period of operation, deposits build up on the heat exchanger tubes greatly reducing heat exchanger efficiency and greatly increasing the energy consumed. Eventually, the heat exchanger must be taken out of operation and the tubes cleaned or replaced. Increasing heat exchanger efficiency and reducing the amount and rate of fouling can provide tremendous energy savings in refineries and other facilities that use heat exchangers.

DESCRIPTION OF THE PRIOR ART

U.S. Pat. No. 4,200,518 claims the use of 1 to 500 parts per million of a polyalkylene amine in a liquid hydrocarbon stream to reduce heat exchanger fouling.

U.S. Pat. Nos. 4,160,648; 4,247,301; 4,191,537; 4,233,168; 4,236,020; 4,288,612 and 4,197,409 all disclose poly(oxyalkylene) carbamates and their use in fuels and lubricants.

SUMMARY OF THE INVENTION

A process for reducing heat exchanger fouling in which a liquid hydrocarbon stream is passed through a heat exchanger at a temperature from 0° to 1500° F. wherein from 1 to 500 parts per million of a poly(oxyalkylene) carbamate antifoulant additive is added to said hydrocarbon stream.

DETAILED DESCRIPTION OF THE INVENTION

The present invention is an improvement over the invention disclosed in the aforementioned U.S. Pat. No. 4,200,518, the entire disclosure of which is incorporated herein by reference. It has been found that the poly(oxyalkylene) carbamates of the present invention are superior in many applications as a heat exchanger antifoulant.

The heat exchangers utilized in the present invention are of any type where deposits accumulate on a heat transfer surface. The most common type of heat exchanger used is commonly known as a shell and tube heat exchanger.

The hydrocarbon stream passing through the heat exchanger is preferably a crude oil or coker feed stream. However, any hydrocarbon stream which leads to fouling of the heat exchanger can be utilized in the present invention, particularly various fractions of the crude oil. Generally, the streams passing through the heat exchanger will be heated or cooled at temperatures ranging from 0° to 1500° F. The additive of the present invention is particularly effective at temperatures of 600° to 1000° F.

The antifouling additive of the present invention comprises a poly(oxyalkylene) carbamate. The carbamates will be soluble in the hydrocarbon stream which passes through the heat exchanger. The poly(oxyalkylene) carbamates, useful in the present invention are well known in the art. Representative United States patents disclosing methods of manufacture and use of the compounds in fuels and lubricants, are: U.S. Pat. Nos. 4,160,648; 4,247,301; 4,191,537; 4,233,168; 4,236,020; 4,288,612 and 4,198,409. The disclosures of these patents are incorporated herein by reference, particularly with regard to the compounds disclosed therein and the method of manufacture.

Generally, the carbamates will comprise at least one hydroxy- or hydrocarbyloxy-terminated poly(oxyalkylene) chain of 2 to 5 carbon atom oxyalkylene units bonded through an oxycarbonyl group to a nitrogen atom of a polyamine having from 2 to 10 amine nitrogens and from 2 to 40 carbons with a carbon-to-nitrogen ratio between about 1:1 and 10:1. The alkoxy group will contain from 1 to 30, preferably 2 to 20 carbon atoms. The compounds will have molecular weights in the range of about 500 to 10,000, preferably from 800 to 5000.

The preferred compounds may be described by the following general formula:

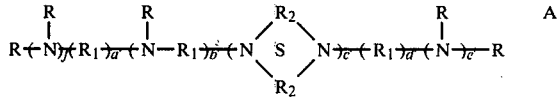

A wherein R is the same or different constituent selected from (I) hydrogen, (II) hydrocarbyl of 1 to 10 carbon atoms, (III) hydrocarbonyl of 2 to 10 carbon atoms, and (IV) a group of the formula

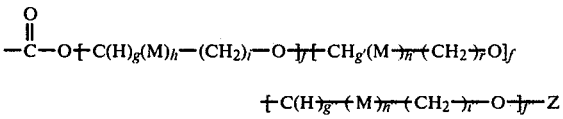

in which g, g', and g'', are integers 1 to 2; h, h' and h'' are 0 or 1; i, i' and i'' are integers 1 to 3; the sum of g and h is 2; M is methyl or ethyl; j, j' and j'' are integers and the sum of j+j'j'' is such that the molecular weight of IV is in the range of 500 to 5000. Z is H or hydrocarbyl of 1 to 30 carbons. $R_1$ is the same of different alkylene or hydroxy-substituted alkylene radical of 2 to 6 carbon atoms, $R_2$ is carbonyl, alkyl carbonyl or alkylene of 2 to 4 carbon atoms with vicinal linkages. At least one, and preferably not more than two of the R groups are IV and sufficient of the oxyalkylene units in IV are other than ethyleneoxy to render the compound soluble in hydrocarbon fuel boiling in the gasoline range. a' is 0 to 1, preferably 1; b' is an integer 0 to 4, preferably 0 to 2; c' is 0 or 1, preferably 0; d' is 0 or 1, preferably 0; e' is 0 or 1, preferably 1; and f' is 0 or 1, and equal to 1 when c' is 0.

The preferred, but not all polyoxyalkylene oxycarbonyl radical substituted amines, which find use in this invention, can be broadly described by the following general formula:

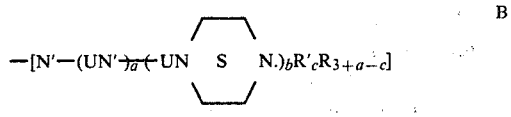

wherein U is an alkylene having from 2 to 6 carbon atoms, there being at least 2 carbon atoms between the nitrogen atoms and preferably of from 2 to 3 carbon atoms; a is an integer from 0 to 5, and preferably of from 0 to 4; b is 0 to 1, preferably 0 when a is greater than 0; a+2b is equal to an integer between 0 and 5; c is an integer from 1 to 4, for the average composition being in the range of about 1 to 3, on the average there being fewer R' groups than nitrogen atoms; R is the same or different constituent selected from hydrogen or a $C_1$ to $C_{10}$ hydrocarbyl or the mono-keto, mono-nitro, mono-hydroxy, alkyleneoxy or alkoxy derivative thereof; and R' is a poly(oxyalkylene) oxycarbonyl radical derived from polymerizing alkylene oxides from 2 to 5 carbon atoms, preferably from 2 to 4 carbon atoms, and more preferably from ethylene oxide and propylene oxide, and having an average molecular weight in the range of 600 to 5000 and chloroformylating said radical with phosgene. Illustrative compounds within the above formula are N-[poly(oxypropylene)oxycarbonyl] ethylenediamine, N[poly(oxypropylene)polyoxyethyleneoxycarbonyl] diethylenetriamine.

The additives are usually prepared by the reaction of a suitable polyether alcohol with phosgene to form a chloroformate followed by reaction of the chloroformate with a mono- or polyamine to form the active carbamate.

The Amine

The amines employed in preparing the additives are as described in formula A with the exception that R will not be of Type IV (which is derived from the polyether chloroformate).

Polyamine Component

The polyamine component embodies a broad class of amines having from 2 to 10 amine nitrogens and from 2 to 40 carbons with a carbon to nitrogen ratio between about 1 and 10:1. In many instances, the amine component is not a pure single product, but rather a mixture of compounds having a major quantity of the designated amine. For the more complicated polyamines, the compositions will be a mixture of amines having as the major product the compound indicated in the average composition and having minor amounts of analogous compounds relatively close in compositions to the dominant compounds.

Exemplary R groups of the amine precursor include alkyls such as methyl, ethyl, propyl, butyl, isobutyl, pentyl, hexyl, octyl, etc., alkenyls such as propentyl, isobutenyl, hexenyl, octenyl, etc., hydroxyalkyls, such as 2-hydroxyethyl, 3-hydroxypropyl, hydroxy-isopropyl, 4-hydroxybutyl, 8-hydroxyoctyl, etc., ketoalkyls such as 2-ketopropyl, 6-ketooctyl, etc., alkoxy and lower alkyleneoxy alkyls, such as ethoxyethyl, ethoxypropyl, propoxyethyl, propoxypropyl, diethyleneoxyethyl, triethyleneoxyethyl, tetraethyleneoxyethyl, diethyleneoxyhexyl, diethyleneoxyoctyl, etc., acetyls such as propionyl, etc. The preferred R groups are hydrogen, $C_1$ to $C_6$ alkyls and $C_1$ to $C_6$ hydroxyalkyls.

Illustrative $R_1$ groups are ethylene, 1,2-propylene, 2,2-dimethyl propylene, trimethylene, tetramethylene, hexamethylene, 1,3,2-hydroxypropylene, etc. The preferred alkylene groups are ethylene and trimethylene.

As already indicated, in many instances a single compound will not be used as a reactant in the preparation of the compositions of this invention. That is mixtures will be used in which one or two compounds will predominate with the average composition or molecular weight as indicated. For example, tetraethylene pentamine prepared by the polymerization of aziridine or reaction of dichloroethylene and ammonia will have both lower and higher amino members, e.g., triethylene tetramine, substituted piperazines and pentaethylene hexamine, but the composition will be mainly tetraethylene pentamine and the empirical formula of the total composition will closely approximate that of tetraethylene pentamine.

The Polyethers

The polyethers or poly(oxyalkylene) materials which are utilized in preparing the polyether carbamates are condensation polymers of the lower aliphatic oxides such as ethylene oxide, propylene oxide, the butylene oxides and the pentylene oxides. The preferred materials are the butylene oxide polymers or poly(butylene glycol). These materials may be terminated or capped on one end by a suitable hydrocarbyl group. For example, particularly preferred materials are capped with a butyl, oleyl groups, etc. The polyoxyalkylene chain may also be terminated by an aryloxy group of 6 to 20 carbon atoms. Also suitable are materials which are capped with mixtures of alkyl groups, i.e., with a mixture of $C_{16}$, $C_{18}$ and $C_{20}$ alkyls. While materials with two terminal hydroxyl groups can be employed, the use of a material containing but one is preferred since chloroformylation will produce a preferred monochloroformate which can then be reacted with a suitable amine to produce the preferred carbamyl material. However, even though some dicarbamate will be formed with the dihydroxy materials, the presence of small amounts of these materials, though not preferred, are not detrimental to the performance of the materials.

The materials may be prepared from mixture of oxide monomers, i.e. when the reactivities of the oxides are relatively equal, random polymers can be prepared. In certain cases, with ethylene oxide, in combination with other oxides, the ethylene oxide reaction rate is much greater, and random polymers cannot be easily prepared. In those cases, block copolymers are prepared.

A particular type of polymer that can be prepared and has been commercially prepared are represented by materials which are prepared by polymerizing propylene oxide to form a first material and then polymerizing ethylene oxide on one or both ends of the poly(oxypropylene). Materials of this type are marketed by Wyandotte Chemicals as "Pluronics."

Preparation of the Polyether Carbamates

The additives of this invention may be most conveniently prepared, as has been previously noted, by reaction of phosgene with the poly(oxyalkylene) compound followed by reaction of the products with a suitable amine.

The reation of the poly(oxyalkylene) material is carried out on an essentially equimolar basis utilizing only a slight excess of phosgene, although an excess of phosgene is not detrimental. The reaction may be carried out at temperatures from −20° to 100° C., preferably in the range of 0° to 30° C. The reaction will usually be complete within ¼ to 5 hours. Times of reaction will usually be in the range of from ½ to 3 hours.

A solvent may be used in the chloroformylation reaction. Suitable solvents include benzene, toluene, etc. It is preferred that the phosgene be dissolved in a suitable solvent before reaction with the poly(oxyalkylene) material.

The reaction of the chloroformate with the amine may be carried out neat or in solution. The molar ratio of amine to chloroformate will usually be in the range of 0.5 to 5. Temperatures of from −10° to 200° C. may be utilized. The desired product may be obtained by water wash and stripping, usually by the aid of vacuum, of any residual solvent.

The mol ratio of the polyether chloroformates to amine will generally be in the range from about 0.2 to 20 mols of amine per mol of chloroformate, and more usually 0.5 to 5 mols of amines per mol of chloroformate. The mol ratio will depend upon the particular chloroformate and the desired ratio of polyether to amine. If suppression of polysubstitution of the alkylene polyamines is desired, large mol excesses of the amine will be used. For example, in particular, preparation with ethylenediamine an amine-chloroformate ratio of 2.5 to 1 has yielded a basic nitrogen to total nitrogen ratio in the product of 0.27, whereas raising the amine chloroformate ratio of 9.1 to 1 gives 0.42 basic nitrogen to total nitrogen ratio, showing a much higher amount of monocarbamate in the material.

The reaction or reactions may be conducted with or without the presence of a reaction solvent. A reaction solvent is generally employed whenever necessary to reduce the viscosity of the reaction product. These solvents should be stable and inert to the reactants and reaction product. Preferred solvents include aliphatic or aromatic hydrocarbons. Depending on the temperature of the reaction, the particular chloroformate used, the mol ratios and the particular amine, as well as the reactant concentrations, the time may vary from ¼ or 24 hours, more usually from about 2 to 3 hours. Times greatly in excess of 3 hours do not particularly enhance the yield and may lead to undesirable degradation, especially at higher temperatures. It is therefore preferred to limit the reaction time to less than 3 hours.

After the reaction has been carried out for a sufficient length of time, the reaction mixture may be subjected to extraction with a hydrocarbon or hydrocarbon-alcohol medium to free the product from any low-molecular weight amine salts which have formed and any unreacted alkylene polyamines. The product may then be isolated by evaporation of the solvent. Small amounts of halogen may be present as the hydrohalide salt of the polyether carbamates.

Depending on the particular application of the composition of this invention, the reaction may be carried out in the medium in which it will ultimately find use, e.g. polyether carriers and be formed at concentrations which provide a concentrate of the detergent composition. Thus, the final mixture may be in a form to be used directly for blending in fuels.

The preferred polyoxyalkyleneoxycarbonyl radical substituted alkylene polyamine compositions have the following formula:

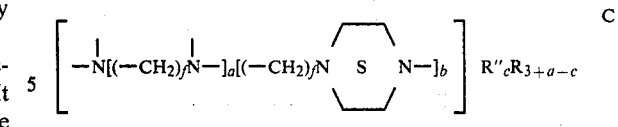

C

The above symbols are defined as follows: a is an integer from 0 to 5, preferably an integer of from 0 to 4; b is an integer from 0 to 1, preferably 0 when a is greater than 0; +2b is equal to a number between 0 and 5; c is an integer in the range of 1 to 3, on the average there being fewer R groups than nitrogen atoms; f is an integer from 2 to 3; R is the same or different constituent selected from hydrogen or a $C_1$ to $C_{10}$ hydrocarbyl or the monoketo, mononitro, monohydroxy, alkyleneoxy or alkoxy derivative thereof; and R″ is a poly(oxyalkylene) oxycarbonyl radical of 600 to 5000 average molecular weight.

The above formulas respresent broad and simplified versions of the preferred poly(oxyalkylene) carbamates which may be employed in the practice of the instant invention. It should be recognized that numerous polyether carbamates not defined by the above formulas may be present in minor quantities. Thus, while the above formulas defined preferred poly(oxyalkylene) carbamates present in major quantities, they should not be interpreted as excluding minor amounts of other components.

To substantially reduce heat exchanger fouling, an effective amount, generally from 1 to 500 parts per million, preferably 2 to 99 parts per million, and most preferably 5 to 29 parts per million of the above-described poly(oxyalkylene) carbamate is added to the stream passing through the heat exchanger. One surprising feature of the present invention resides in the finding that small quantities of the above-described additive are effective in reducing the heat exchanger fouling.

EXAMPLE—ANTIFOULING TESTS

A polybutene amine as taught in U.S. Pat. No. 4,200,518 and a poly(oxyalkylene) carbamate as described in the present application were tested for their antifouling characteristics using a standard ALCOR Test Apparatus. This test involves feeding a test stock material at a fixed rate and for a fixed period of time and at constant inlet temperature into a tube containing a stainless steel electrically heated rod while supplying enough heat to the rod to maintain the outlet temperature of the test stock constant. As fouling deposits form on the rod, the temperature of the rod must be increased to maintain a constant outlet temperature of the test stock. The initial rod temperature and final rod temperature are measured along with the initial and final weight of the rod. The increase in rod temperature and the amount of deposits on the rod are indicative of the degree and rate of fouling. Comparisons were made with various feedstocks and with varying concentrations of additive. The results are shown below in Table I. Feedstock A was a crude having a sulfur content of 0.95 weight percent. Feedstock B was a refinery naphtha. Feedstock C was a crude having a sulfur content of 0.72 weight percent.

TABLE I

| Test Stock | Additive | Heater Rod Temperature Increase (°F.) | Fouling Deposit Wt. (Mg) |
|---|---|---|---|
| A | None | 13 | 6.5 |
| A | polybutene amine (5 ppm) | 8 | 5.4 |
| A | poly(oxyalkylene) carbamate (5 ppm) | 2 | 0 |
| B | None | 4 | 15.3 |
| B | polybutene amine (50 ppm) | 2 | 16.6 |
| B | poly(oxyalkylene) carbamate (50 ppm) | −5 | 3.0 |
| C | None | 25 | 2.5 |
| C | polybutene amine (50 ppm) | 4 | 2.0 |
| C | poly(oxyalkylene) carbamate (50 ppm) | 4 | 2.0 |

The poly(oxyalkylene) carbamate and the polybutene amine both had molecular weights in the range of 1000 to 2000.

The above data indicates that with the feedstocks tested that the poly(oxyalkylene) carbamates are equal to or surprisingly superior to the polybutene amine additive of U.S. Pat. No. 4,200,518.

What is claimed is:

1. A process for reducing heat exchanger fouling in which a liquid hydrocarbon stream is passed through a heat exchanger at a temperature from 0° to 1500° F. wherein from 1 to 500 parts per million of a poly(oxyalkylene) carbamate is added to said hydrocarbon stream.

2. The process of claim 1 wherein said liquid hydrocarbon stream is crude oil and is passed through said heat exchanger at a temperature from 50° to 500° F.

3. The process of claim 1 wherein said hydrocarbon stream is a coker feed and is passed through said heat exchanger at a temperature from 600° to 1000° F.

4. The process of claim 1, 2 or 3 wherein said hydrocarbon stream has a sulfur content of from 0.1 to 5.0 weight percent.

5. The process of claim 1 wherein 2 to 99 parts per million of said additive are added to said stream.

6. The process of claim 1 wherein 5 to 29 parts per million of said poly(oxyalkylene) carbamate is added to said stream.

7. The process of claim 6 wherein said heat exchanger is a shell and tube heat exchanger.

8. The process of claim 1 wherein said poly(oxyalkylene) carbamate has at least one $C_1$–$C_{30}$ hydrocarbyloxyterminated poly(oxyalkylene) chain of 2 to 5 carbon oxyalkylene units bonded through an oxycarbonyl group to a nitrogen atom of a polyamine; said polyamine having from 2 to 10 amine nitrogens and from 2 to 40 carbon atoms, said carbamate having a molecular weight of from about 500 to 10,000.

9. The process of claim 8 wherein the oxyalkylene units contain 3 to 4 carbon atoms.

10. The process of claim 8 wherein the molecular weight is from about 800 to 5000.

11. The process of claim 8 wherein the group terminating the poly(oxyalkylene) chain is an alkoxy group containing from 2 to 20 carbon atoms.

12. The process of claim 8 wherein the group terminating the polyoxyalkylene chain is an aryloxy group of 6 to 20 carbon atoms.

13. The process of claim 11 wherein the alkoxy group contains 16 to 20 carbon atoms.

14. The process of claim 13 wherein the alkoxy group comprises a mixture of $C_{16}$, $C_{18}$ and $C_{20}$ carbon groups.

15. The process of claim 9 wherein the amine is ethylenediamine.

16. The process of claim 9 wherein the amine is diethylenetriamine.

* * * * *